United States Patent [19]

Lyons

[11] Patent Number: 4,958,601

[45] Date of Patent: Sep. 25, 1990

[54] VALVED PISTON WITH ROCKER ARM JOURNALED TO PISTON

[76] Inventor: H. Clayton Lyons, P.O. Box 1737, Brookings, Oreg. 97415

[21] Appl. No.: 249,873

[22] Filed: Sep. 19, 1988

[51] Int. Cl.[5] ..... F01L 11/00

[52] U.S. Cl. ..... 123/47 R

[58] Field of Search ..... 123/47 R, 47 A, 47 AB

[56] References Cited

U.S. PATENT DOCUMENTS

| | | | |
|---|---|---|---|
| 1,513,397 | 10/1924 | Irish | 123/47 R |
| 2,215,793 | 9/1940 | Mayes | 123/47 A |
| 4,727,794 | 3/1988 | Kmicikiewicz | 123/55 A |

FOREIGN PATENT DOCUMENTS

| | | | |
|---|---|---|---|
| 445848 | 11/1912 | France | 123/47 A |
| 503618 | 6/1920 | France | 123/47 R |
| 568753 | 4/1945 | United Kingdom | 123/47 A |

*Primary Examiner*—David A. Okonsky
*Attorney, Agent, or Firm*—Neil J. Driscoll

[57] ABSTRACT

The invention comprises an internal combustion engine having at least one cylinder, a movable piston in the cylinder, a valve in the head of the piston, a push pin engaging the valve, a rocker arm pivoted at one end to the piston and engaging the push pin, and cam means to move the arm and thereby open and close the valve.

3 Claims, 3 Drawing Sheets

4
29
30
28
27
3
1
5
17
59
36
43
18
26
2
3
10
14
19
12
15
16
37
9
38
11
7
13
8
40
45
39
24
21
44
20
35
33
31
34
32
6
22
23
43
42
26
44

VALVED PISTON WITH ROCKER ARM JOURNALED TO PISTON

BACKGROUND OF THE INVENTION

1. Field of the Invention

In consideration of the dwindling reserve of fossil fuels and the absence of a suitable fuel, and to revitalize the U. S. leadership in design and manufacturing of automobile, marine, aircraft and industrial engines and associated equipment. A revolutionary new fuel efficient Internal Combustion Engine System is disclosed which is lighter weight, more compact, and in many ways more economical to produce. Described is a Two Cycle Diesel Engine but not limited to a Two Cycle Diesel Engine. In the present petroleum based fuels and the associated Internal Combustion Engines there is a high percentage of wasted energy in producing a given amount of power on the crankshaft. In the current State of the Art, the better engines will produce horsepower equivalent to approximately 35% of the total energy in a given quantity of fuel. Of the remaining energy, variously 25% to 30% is lost to cooling of the engine and approximately 35% of the energy is wasted out the exhaust. The general consensus is that the exhaust energy loss is primarily the heat loss. However, studies and experimentation have proven that the greater loss in the exhaust is in the pressure loss of the Exhaust Cycle Function. At max BME, max torque range, the pressure in the combustion area is in the order of 250–350 PSI when the exhaust valve or port starts to open. This high pressure is instantaneously released to atmospheric pressure and the noise of the sudden release of pressure is commonly thought to be the sound of the combustion function (explosion). In reality, this noise is caused by the sudden release of high pressure energy and constitutes large energy loss. In the case of turbocharged engines this exhaust energy is released to a mere back pressure pf 6–15 PSI.

SUMMARY

In the complexity of explaining this revolutionary New Internal Combustion Engine System, it is expedient to define this engine firstly in two phases and will enter into a closely associated Phase Three Engine in a subsequent application. The Phase One Engine is inherent to and leads to the Phase Two Engine and further leads to the Phase Three Compound Internal Combustion/Exhaust Gas Turbine Energy Recovery System which will be subsequent application.

The Phase One Engine is a basic Single Cylinder Diesel. A revolutionary new, useful and practical system. This Phase One Engine utilizes a Camshaft Timed Intake Valve in Piston principle, a Non-cooled Hot Running Cylinder Head, with partially insulated and coolant chilled insert for the diesel injector, an Internal Crankcase Isolated Lubrication System and Chilled Exhaust Port Webs. This series to include Single Cylinder and Multiple Cylinder Crankcase Compression for the Scavenge Cycle of a Two Cycle Engine.

The Phase Two Engine is a Multiple Cylinder Radial Engine with Single Throw Crankshaft but not limited to a Single Row Radial. This engine embodies the Free Piston Principle of distributing the load of the functions of compression and exhaust cycles with very little effect from and on the crankpin of the crankshaft. This is accomplished by utilizing a Bearing Cartridge Connecting Rod Cluster with each Connecting Rod individually impinging on a Heavy Outer Shell of the Connecting Rod Journal Bearing and thus directly performing the functions of a Free Piston Engine. This Phase Two Engine does not require an external source of crankcase pressurization for the Exhaust Scavenge/Intake functions.

PREFERRED EMBODIMENTS

Figure 7:
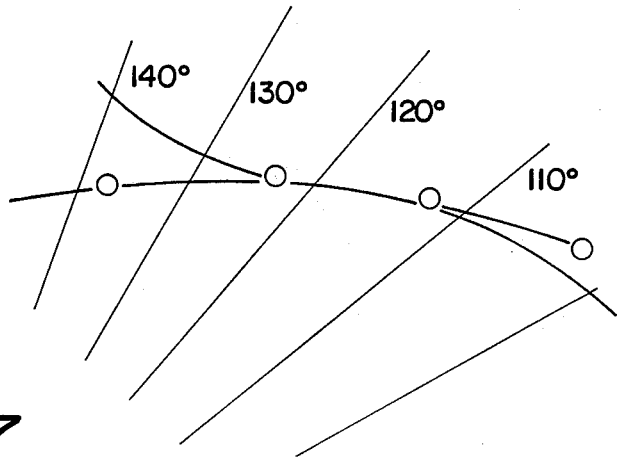
FIG. 7 is a graphic view showing the relative motion of components during engine operating.
Figure 8:
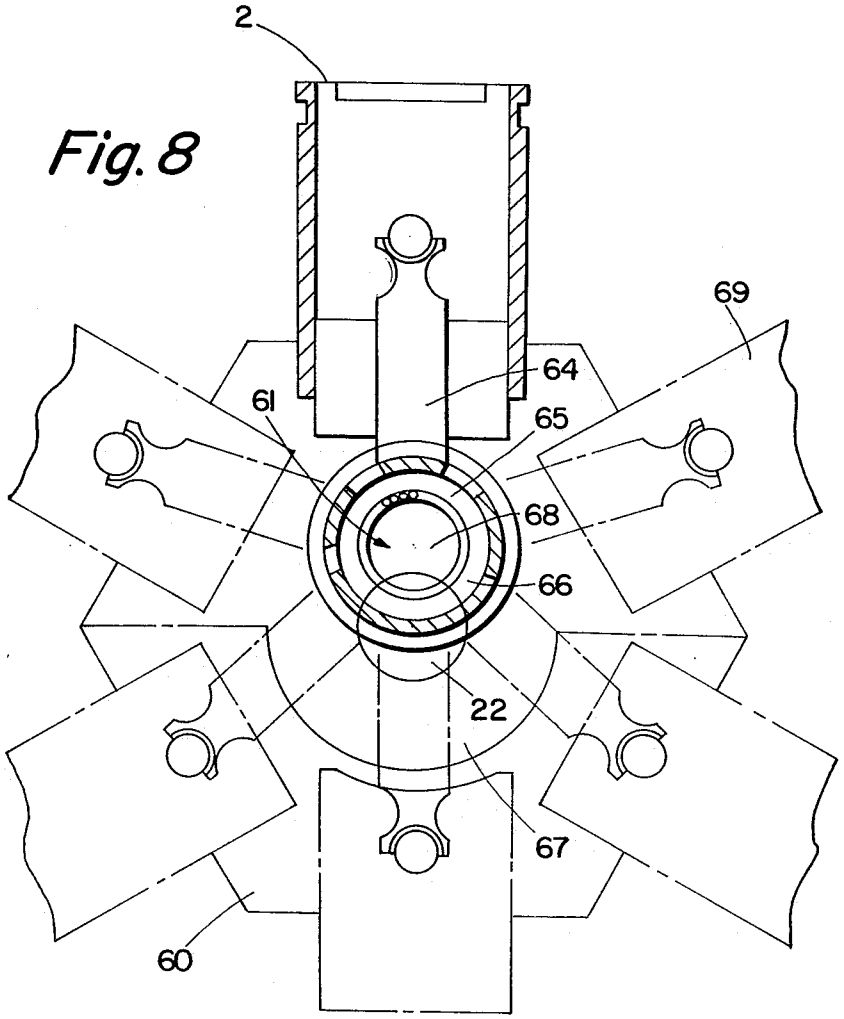
FIGS. 8 & 9 are fragments of the graph at FIG. 7.
Figure 9:
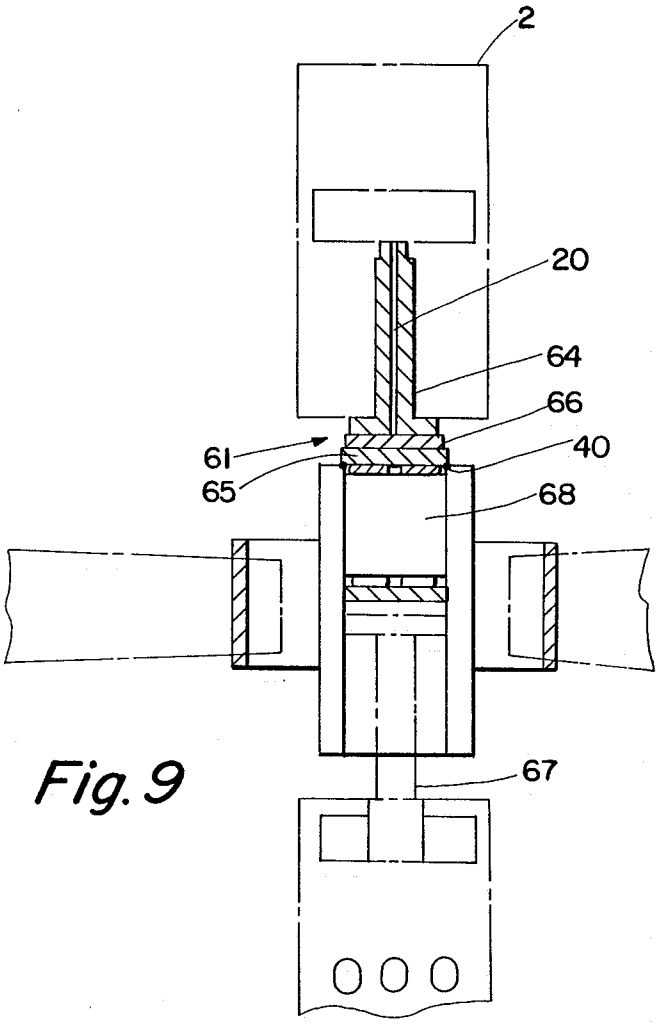

Key to the basic concept is an Intake Valve-1 oriented on center line of the Piston-2 at its upper extremity and is within the Combustion Chamber-3 form of a Semi-Sperical Bowl-4 with its upper form being open but curving upward and inward from the Valve Seat-5 to the top of said Piston-2. Said Combustion Chamber-3 and Valve-1 move with said Piston-2, and said Valve-1 is timed by Cam-6 action to accurately open and close said Intake Valve-1 relative to the rotation of said Cam-6 and motion of said Piston-2. The Valve and its Actuating Rocker Arm-7 is mounted in said Piston and moving with said Piston at high cyclic rates, (4000 RPM). The Rocker Arm is hinged with its Hinge Pin-8 being transverse to the Wrist Pin-9 at its one extremity and affixed to the Inner Wall-10, of the Piston Skirt-11 and below said Wrist Pin-9. The other extremity of said Rocker Arm-7 extends well beyond the center line of said Valve Stem-12. Said Rocker Arm is actuated by an Adjustable Tappet-13 extension of a Cam Follower-14 in such manner as to cause said Rocker Arm to raise and open said Valve through Push Pin-15 oriented to said Wrist Pin-9 and parallel to said Valve Stem and on center line of said Valve but transverse to said Wrist Pin in such a way that when the action of said Cam Follower impinges on the downward traveling Piston-2 and Rocker Arm-7 causing said Rocker Arm to force said Push Pins to raise said Valve by pushing on the underside of the Head of said Valve. A Valve Spring-16 is on said Valve Stem in the conventional manner. The piston is moving downward while said Cam is lowering said Cam Follower at a rate slightly less than the downward movement of said Piston (See circular graph of motion of the piston verses motion of camshaft rotation (FIG. 7). The downward motion of said Piston and its Rocker Arm-7 overtakes the downward moving Cam Follower-14 and momentarily parallels the two motions to allow a very gentle contact with said Rocker Arm at point- 46 which begins the Valve Opening functions. In approximately 5' further rotation the Cam action now departs at point- 47 from the motion of said Piston until the point-48 of desired Valve Opening is achieved.

After point-48 said Piston starts its upward travel from BDC and said Cam Follower is pursing said Piston's upward motion but at a lesser rate until said Valve nears its Valve Seat, then said Cam Follower's rate momentarily parallels the rate of said Piston at point-49 and gently lowers said Valve on its seat at or near point-50 where Valve closing timing is desired. Note: Said Intake Valve-Al closing point is a few degrees after closure of the Piston Port Exhaust-18. This allows a building of pressure above said Piston when or if there is sufficient pressure in said Crankcase-19 to do so. This function allows a supercharging effect that is not obtainable in a Piston Port Intake/Exhaust System common to most Two Cycle Crankcase Scavenged Engines.

It will also be noted that after said Valve closes said Cam Follower and its Cam gradually slows and stops its upward travel at approximately point-51. Said Piston with closed Valve continues its acceleration upward. A Cam Follower Return Spring-19 causes said Cam Follower to follow the contour of said Cam. While said Valve is closing the rapidly accelerating Piston-1 has the tendency to close said Valve even if there were not a Valve Closing Spring-16. By 90′ before TDC the compression pressure begins to put force on said Valve and this pressure continues to increase exerting a major closing force decelerate but the force of the compression pressure is building sufficiently that said Valve does not leave its Seat-5 and would not require a Valve Spring-16 even when the deceleration of said Piston is near its greatest rate. In an 18:1 Compression Ratio the force on the top of a 2 inch Valve is over 1000 Lb. before combustion takes place. When fuel injection and combustion start and subsequent reversal of direction begins at TDC said Piston is rapidly accelerating downward, but again the force on top of said Valve is even greater than the maximum force was during the compression stroke. If the fuel were cut off and no combustion occurred the force of compression would still hold said Valve closed without a Valve Spring through approximately 70′ after TDC at which time acceleration of said Piston ends due to the articulation motion of said Connecting Rod-20 and said Valve would remain closed until pressure in said Crankcase-21 overcame pressure remaining above said Piston. Note! Said Piston-2 is now decelerating again to further aid in keeping said Valve-A1 closed. Only a relatively light Valve Spring-16 is required on said Intake Valve-1 due to the acceleration and deceleration of said Piston with said Intake Valve in the Head of said Piston and pressures in said Combustion Area. Now said Cam-6 lowers said Cam Follower-14 to the point of desired position of intercepting the downward moving Piston-2 and Rocker Arm-7 for the next Intake Valve-1 opening function. It will be noted that said Rocker Arm needs an Adjustable Stop-13 to keep said rocker Arm from beating itself to death due to the deceleration and acceleration of said Piston while said Rocker Arm is not in attendance with said Cam Follower-14 from about 90′ before TDC until 90′ after TDC. Said Adjustable Stop-13 is oriented and adjustable to said Rocker Arm to a minute degree of backlash and further is cushioned and harmonic vibration dampened by a Button of Cushioning Material while said Cam Follower is not in attendance with said Rocker Arm in the upper cycles of said Piston.

Figures 1, 2, 3, 4:
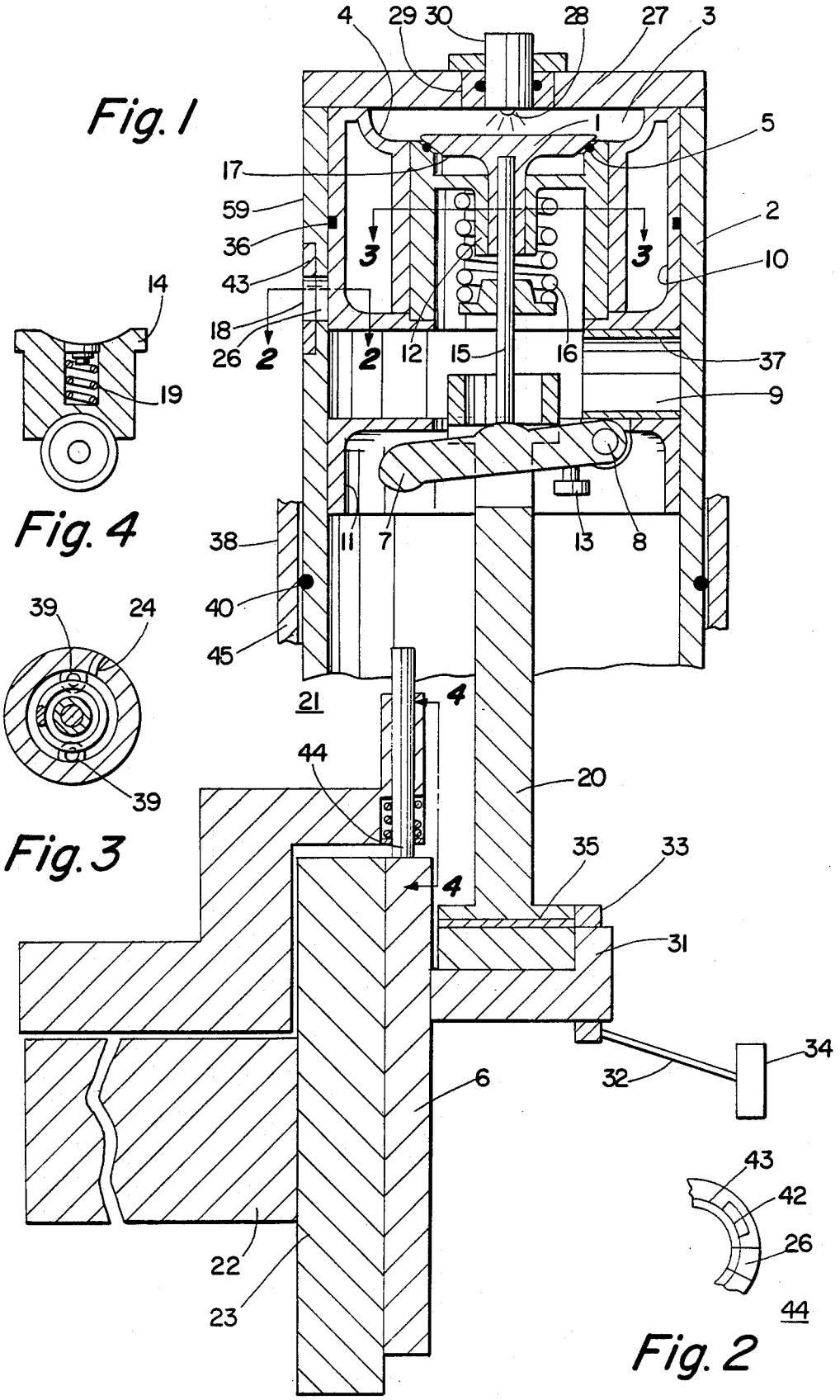
FIG. 1 is a fragmentary vertical sectional view showing typical piston, connecting rod and valve construction employed in the invention.
FIG. 2 is a fragmentary elevational view taken along line 2—2 of FIG. 1.
FIG. 3 is a fragmentary sectional view taken along line 3—3 of FIG. 1.
FIG. 4 is a fragmentary sectional view taken along line 4—4 of FIG. 1.
Figure 5:
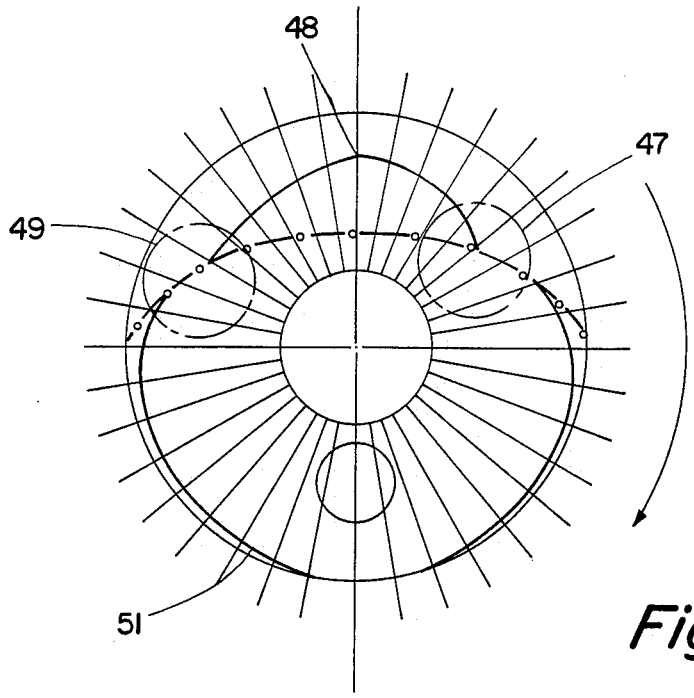
FIG. 5 is a fragmentary elevational view of a six cylinder engine.
Figure 6:
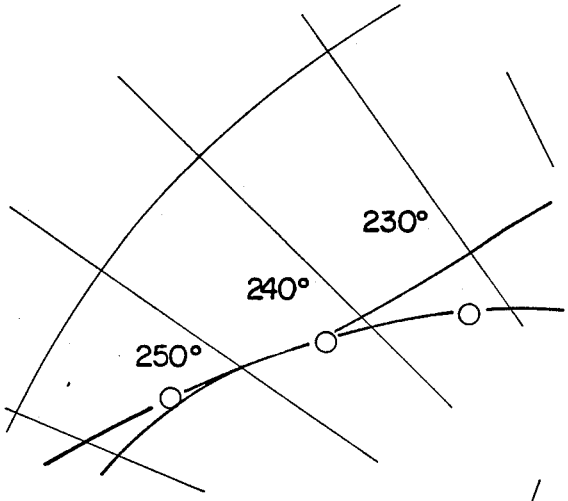
FIG. 6 is a fragmentary end elevational view of the structure of FIG. 5.

FIG. 1 shows a Direct Acting Cam Follower-14 acting on said Cam which is on the Web-22 of said Crankshaft-23. Special Note! This orientation of Cam is not limited to being on the Web of said Crankshaft but since in a Two Cycle Engine the Cam rotates at a 1-1 ratio and said Cam may be located elsewhere on the Crankshaft Main Bearing Line or gear driven as design dictates Regarding the Intake Valve-1 in Combustion Chamber-3 in the Head of said Piston-2 a spiral or rotating action is accomplished as the incoming air rushes through the open Valve-1 This air rotation action is achieved by an Air Deflecting Stator Vane-24 which is also the Support Web-24 of the Intake Valve Guide-25 and Push Pin Guides-39 and is a part of said Piston-2 structure. This enhances the Exhaust Scavenge by the inward curvature of said Combustion Chamber-3 as the air moves toward the top of said Piston thus creating a Swirling Cone of incoming air. This upward and inward curvature of said Combustion chamber-3 also acts as a deflector that the fresh incoming air does not take the shortest route to said Exhaust Ports-26 which are now open. A "Squishing Action" occurs as the Upper Top Flat Portion of said Piston approaches the flat internal side of said Cylinder Head-27. This in combination with the circular motion accelerates this motion thus performing the act of greater exposure of the High Pressure Diesel Fuel Injection Stream-28 to the oxidizing air.

NON-COOLED CYLINDER HEAD (HOT RUNNING)

The concept of a hotter running combustion area of a Non-Cooled Cylinder Head-27, (Temperature range 900′ f to 1600′ f) is revolutionary, new and practical art. Less heat absorption from the hot gases in the Combustion Area transfers the otherwise lost energy to the power stroke. A Liquid Chilled Insert-29 is provided in this Hot Head-27 to control the temperature where and when needed for the functions of the Diesel Injector Nozzle-30.

A SEALED AND ISOLATED INTERNAL CRANKCASE LUBRICATION SYSTEM

In the diesel Principle of a Two Cycle engine breathing through the Crankcase-21, it is not feasible to use the conventional Crankcase Lubrication System because large amounts of the Loose Oil Mist would be carried into the combustion area. This is a revolutionary, new, useful and practical system to lubricate a Two Cycle Crankcase Breathing diesel or gasoline engine, using an Overhung Crankshaft-23 but not limited to this configuration of Crankshaft, with one end of said Crankpin-31 unsupported. The Lubricating Oil Line-32 is not a part of said Crankshaft-23, but a short Oil Line protrudes from the Crankpin-31 at its open end and orients toward a Swivel Mounted and Rotary Oil Sealed Fitting-33 which rotates on center line of the Main Bearings. A Semi-Flexible Tube-32 connects these two Oil Passages and is also the pulling force that rotates said Swivel Fitting-33 In addition the Oil Pump-34 is driven directly by the rotation of said Swivel and Oil Sealed Fitting-33 and rotates said Positive Displacement Lubricating Pump-34 at engine rpm. Said Positive Displacement Pump is also throttable as pertains to the quantity of lubricant pumped per revolution and its throttle is coordinated with the Main Engine Fuel throttle Linkage. Said Pump the delivers metered throttled lubricant to said Swivel 33 and proportional to the amount of engine throttle opening and subsequent load on said Connecting Rod Journal Bearing-35, Wrist Pin-9 and Piston Rings-36. Said Connecting Rod Bearing Chamber-35 is rotationally sealed at both ends. Lubricant passes into the Bearing cartridge Roller Chamber, replenishing said lubricant therein and the surplus passes through said Roller Bearing and on through the Outer Race of said Roller Bearing and will direct Lubricant through a passage in said Connecting Rod-20 to passages in said Wrist Pin-9 and on to the rotationally sealed Wrist Pin Bearings-37 and through passages in said Piston on up to a point on said Piston between the two Compression Rings-36. Said lubrication oil is now enclosed from said Oil Pump-34 to passages through said Piston wherein said Lube Oil becomes free at a point between said Piston Rings-36 thus ensuring a replenishing flow of lubricant to said Connecting Rod Journal Bearing-35, said Wrist Pin Bearings-37 and said Piston Rings-36 and further distributes the oil to said Cylinder Wall-38 and said Piston Skirt-A1 There is some misting of said oil from said Piston Skirt and Lower Cylinder Walls-38 which will churn momentarily in said Crankcase-21 and affords lubrication to Valve Guides-25 Push Pin Guides-39, Cam Followers-14 and Rocker Arm Hinge Pins-8. Said Lubricant will be as a number 2 diesel oil with a low 5 of additive of lube oil and a volume equivalent to approximately 2% of the diesel fuel injected to the firing cylinder. There will be some leakage of this lubricating oil and any mist thereof will move on through the Intake Valve-1 in piston and will be efficiently and effectively ignited in the Diesel Auto Ignition. That portion of the diesel fuel and oil which clings to said Cylinder Walls and Piston Top will not ignite due to the relatively cool Cylinder Walls and Piston. Said clinging oil adds to the lubrication of Piston Skirt-11 and Piston Rings-36. It will be noted that the interior crankcase cooling of most Four Cycle engines and some Two Cycle diesel engines is achieved by massive amounts of engine lubricating oil. Internal crankcase cooling of this Invention is achieved in said crankcase area by the volume of incoming relatively cool intake air and with very little loss of lubricants. Said main bearing and its supporting bearing now runs in a separate normal oil lubricated housing. There is other gearing inside this oil lubricated housing. This oil is isolated from said Crankcase by appropriate Rotational Seals on Bearings, Torque Shafts and other places as required.

LIQUID CHILLED EXHAUST PORT WEBS

The design principle of Liquid Chilled Exhaust Port Webs-41 ia revolutionary, new and practical achievement. In the removable Wet Cylinder Sleeve-59 of a Two Cycle engine, Exhaust Ports-26 at the appropriate place low in the active cylinder surfaces. Said Exhaust Port Web-41 would run unacceptably hot at higher power settings, if not chilled. The Coolant Passage-42 are longer than the width of a band as is forthcoming. Next a Rust Resistant Bonded Band-43 is oven braized or otherwise bonded around the outer periphery before said Exhaust Ports-26 are milled and is wider than the height of said ports. Said Ports are now milled in their proper place between said Cooled Exhaust Port Webs-41. Sealing"O" Rings-40 are oriented in the Cylinder Housing-45 to enclose the upper and lower portions of said Bonded Metal Band-43. The cylinder coolant passes upward through said Coolant Passages-42, and on up the outer surface of said Cylinder Sleeve-38 and will function with the normal coolant circulating system. This allows coolant to pass through the Webs while Sealing O rings-40 isolate the Coolant from the Exhaust Port Plenum-44.

A counter rotating counterweight shaft will be utilized on the single cylinder and two cylinder engines to control vibration to an acceptable level.

PHASE TWO ENGINE

This multiple Cylinder Radial Diesel Engine utilizes the several principles of the Phase One Engine i.e.: The Timed Intake Valve in Head of Piston, the Non-Cooled Hot Running Cylinder Head with Chilled Insert for Diesel Fuel Injector, the Chilled Exhaust Port Webs, and the Internally Sealed Crankcase Lubrication System. This Multiple Cylinder Radial Engine requires an external air pressure source applied to the Internal Crankcase to accomodate the several cylinders on a single throw crankshaft and common crankcase chamber to facilitate exhaust gas scavenge/fresh air intake functions of the Two Cycle Engine Cylinder. In addition, the Semi-Free Piston Principle through the application of a Bearing Cartridge Connecting Rod Cluster-61. In the "Free" Piston Principle of an Internal Combustion Engine there is no crankshaft, but the firing Cylinder and its power stroke forces the opposite Piston through its compression stroke and where there is sufficient mass weight of said Pistons and Connecting Rod, continues its cycles without the presence of a Crankshaft. Through the use of a connecting Rod Bearing Cluster-61, the principle of Free Piston Engine of which the "Semi-Free Piston Principle", herein described on a Six Cylinder Radial Engine in order to achieve simplication of the description of the functions of this Semi-Free Piston Engine, but not limited to fewer or more Cylinders. The #1 Connecting Rod-64 is pinned or otherwise affixed at its Slipper-66 to the outer periphery of the Heavy Outer Shell-65 of the Connecting Rod Bearing Race that the Outer Bearing Race does not rotate but does oscilate/articuate with said #1 Connecting Rod. The other Connecting Rod Slippers in turn are free to oscilate on the outer surface of said Connecting Rod Bearing Shell. Now when the #1 Piston-D2 is at TDC of its firing stroke the #4 Piston is at BDC and said #1 Connecting Rod acts directly through said Outer heavy Shell of said Connecting Rod Bearing Cluster and on to #4 Slipper and Connecting Rod of #4 Piston to accelerate said #4 Piston from BDC without the resistant force being felt on the Connecting Rod Journal-68 of said Crankshaft. At the next 60' of rotation of said Crankshaft the #2 Piston fires with the forces of the #2 Piston acting directly on the #5 Piston in said Two Cycle Engine and also contributes some helping force to the #4 and the #6 Piston, and this action continues each 60' of Crankshaft rotation as #3 Piston fires, #4 Piston fires, etc. Said Connecting Rod Journal is now feeling very little of the forces required to reverse direction of said Pistons that are coming through BDC, and to cause the BDC Piston to continue through its acceleration and compression cycle, and where said Pistons are of sufficient weight and a given RPM this compression action of said Piston is aided by the kinetic energy motion of deceleration which more or less completes its compression stroke with minimum stress felt on said Crankpin. This configuration of engine would almost run without a Crankshaft, and therefore functions with a less massive Crankshaft. The more cylinders we have, the more efficient is the Semi-Free Piston Piston Principle of the operation. The collective Connecting Rod Slipper Pads-66 are retained by two Outer Slip Rings-62 oriented to the outer surface of said Slipper Pads and said Retaining Rings keep said Slipper Pads at minute proximity to the Outer Shell of the Bearing Race-65. Primarily! This is now a Six Cylinder "Semi-Free Piston" Engine with said Crankshaft presence primarily to pick up the net torque driving force of the engine and serving to keep said Pistons in time and to drive the Valve Timing Mechanism, Diesel Fuel Injection Pump, Valve Opening Cam actions and other accessories. This, I claim to be revolutionary, useful, lighter in weight, more economical to produce, more compact and fuel efficient and with a longer life expectancy than the present State of the Art in a Two Cycle Diesel Engine and in many aspects Two Cycle gasoline fueled and Four Cycle Engines.

In the current State of the Art of multiple cylinder radial engines utilizing a master connecting rod journaled on the crankpin of the crankshaft of each row of the Radial Engine and the remaining cylinders being connected radialy to this master connecting rod through articulating Link Rods. Said Link Rods have a different angular articulation than the Master Connecting Rod and alters their Pistons TDC timing and linear motion rates thus seriously effecting ignition timing, combustion timing and Valve timing as compared to the Piston of the Master Connecting Rod. In this invention each Connecting Rod articulates equally around the center line of the Crankpin and thus has equal angular deflection in their articulating motions. BUT! In my invention, the application of the Semi_Free Piston Principle, through the application of the Connecting Rod Journal Bearing Cluster and Connecting Rod Slipper Pads and its valuable improvement over any known or existing engine systems. In a further discussion of the advantages of the Two Cycle Engine I teach in a Single Cylinder Two Cycle Engines, operating at midrange power, that if the Connecting Rod Bearing Cap were to come off, the Connecting Rod would not leave the Journal until or unless the Cylinder failed to fire or the Throttle were closed and with no pulling force felt on the Connecting Rod Journal. This means that when a bearing wears to excessive clearance in a Two Cycle Engine the Connecting Rod Bearing does not beat itself to death due to backlash as it does in a Four Cycle Engine wherein every other stroke is a pulling stroke on the Connecting Rod.

The Turbocharger at its present state of the art does not recover some of the Exhaust Pressure Energy to drive a supercharger but only a minute percentage of exhaust energy is used here. I teach that the Turbocharger is not a fuel saver in the terms of fuel consumption, "Pounds per brake horsepower per hour" (11b./BHP?Hr.) in the present conventional Turbocharged Four Cycle Engine, but in reality in the gasoline and alcohol fueled engines, is a waster in view of the richer mixture required to control detonation at the higher boosted intake pressures and associated temperatures, but with a sacrifice in fuel consumption does allow increases in horsepower in a relatively smaller engine.

A further advantage in this engine is a Modular Component Parts Replacement System. The Cylinder is a complete fabricated piece with its Coolant Jackets in place. In both the Single Cylinder Engine and the Multiple Cylinder Radial Engine, I use a removable Cylinder with Cylinder Head attached. The Piston assembly with Intake Valves and Rocker Arm installed is also removable after the Cylinder is removed from the Crankcase. In the maintenance and repair procedures it is a very simple operation to replace a failed Cylinder or Piston Assembly or both with minimum disassembly and minimum tools. In comparison to the repair or replacement of a cylinder block of a multiple cylinder engine is astronomically easier to do.

In addition and in forthcoming applications I will show reduction of undesirable emissions through the use of Catalyst and high pressure injections of other substances at appropriate times and places.

I claim:

1. In a two cycle internal combustion engine the combination of, cylinder, a movable piston in the cylinder, an intake valve in the head of the piston, at least one push pin impinging on said intake valve, a rocker arm journaled to the piston and engaging an end of said push pin, and cam means engaging the rocker arm and operative to pivotally move said arm whereby said push pin is moved vertically to sequentially open and close said intake valve.

2. A two cycle internal combustion engine according to claim 1 and including a cam follower oriented to a cam track rotated at crankshaft speed and arranged that said cam follower moves in a prescribed motion relative to the motion of said piston and its rocker arm, said cam follower is impinged upon by the downward moving piston and its valve opening rocker arm in such a way as to time the opening and closing of said valve at the proper timing to afford the passage of intake air into the upper cylinder and combustion area, the point in timing where the downward traveling rocker arm approaches the downward traveling cam follower the two downward motions momentarily parallel each other so that the contact between the rocker arm and cam follower is very gentle and similarly the closing function similarly parallels during the upward motion of the cam follower and rocker arm, thus gently affording final closure of the valve.

3. A two cycle internal combustion engine according to claim 2, wherein the top of said piston is in the form of a bowl with the valve being in said bowel and below the top of said piston, thus the bowel comprises the greater volume of the combustion chamber when said Piston is at top dead center, stator vanes are position below the valve and give a rotational motion to the air as it rushes upward through the open, said rotation motion of air creates a rotational cone of incoming fresh air and further affords better scavenging of the exhaust from the cylinder, the travel of said piston upward in the compression stroke and approaches said cylinder head, the air is forced inward between the top of the piston and the flat surface of said cylinder head increasing the exposure of the injected fuel for greater exposure to the oxidizing air.

* * * * *